US012091274B2

(12) United States Patent
Herrmann

(10) Patent No.: US 12,091,274 B2
(45) Date of Patent: Sep. 17, 2024

(54) REMOVABLE RAISED TRAY SYSTEM FOR SMALL SET PRODUCTION

(71) Applicant: Xerox Corporation, Norwalk, CT (US)

(72) Inventor: Douglas K. Herrmann, Webster, NY (US)

(73) Assignee: XEROX CORPORATION, Norwalk, CT (US)

( * ) Notice: Subject to any disclaimer, the term of this patent is extended or adjusted under 35 U.S.C. 154(b) by 197 days.

(21) Appl. No.: 17/932,437

(22) Filed: Sep. 15, 2022

(65) Prior Publication Data

US 2024/0092602 A1 Mar. 21, 2024

(51) Int. Cl.

| | |
|---|---|
| ***B65H 31/18*** | (2006.01) |
| ***B65H 1/04*** | (2006.01) |
| ***B65H 1/14*** | (2006.01) |
| ***B65H 29/38*** | (2006.01) |
| ***B65H 31/22*** | (2006.01) |

(52) U.S. Cl.

CPC ..... *B65H 29/38* (2013.01); *B65H 1/04* (2013.01); *B65H 1/14* (2013.01); *B65H 31/18* (2013.01); *B65H 31/22* (2013.01); *B65H 2301/4212* (2013.01); *B65H 2301/42256* (2013.01); *B65H 2405/15* (2013.01); *B65H 2801/21* (2013.01)

(58) Field of Classification Search

CPC . B65H 1/14; B65H 1/04; B65H 1/266; B65H 31/18; B65H 31/22; B65H 2405/15; B65H 2601/324; B65H 29/38; B65H 2301/42256; B41J 13/103; G03G 15/6502; G03G 15/6505; G03G 15/6552

See application file for complete search history.

(56) References Cited

U.S. PATENT DOCUMENTS

| | | | | |
|---|---|---|---|---|
| 8,147,175 | B2 * | 4/2012 | Brewer, III | B65H 31/22 414/349 |
| 9,624,062 | B1 | 4/2017 | Herrmann | |
| 10,046,929 | B1 | 8/2018 | Gunnell | |
| 10,442,642 | B2 | 10/2019 | Gunnell | |
| 11,247,504 | B2 | 2/2022 | Herrmann | |
| 2006/0244202 | A1 * | 11/2006 | Herrmann | B65H 31/32 271/147 |
| 2008/0170902 | A1 * | 7/2008 | Nakazawa | B41J 13/106 400/624 |
| 2010/0295240 | A1 * | 11/2010 | Brewer, III | B65H 31/22 271/220 |

* cited by examiner

*Primary Examiner* — Luis A Gonzalez

(74) *Attorney, Agent, or Firm* — Simpson & Simpson, PLLC

(57) ABSTRACT

A removable raised tray system for a printing system generally includes a removable tray operatively arranged to receive print media thereon. The removable tray includes an upper tray surface having an electrically conductive material, a lower tray surface, and at least one tray leg that is connected to the removable tray, which is configured to support the removable tray at a position that is raised relative to a platform surface of a printer feeder or stacker. The at least one leg includes a releasable fastening assembly, such as a rare earth magnet, that releasably secures the removable tray to the platform surface thereby allowing the tray to easily attached and removed from the printer feeder or stacker. The electrically conductive material of the tray surface and the platform surface are electrically conductively connected to one another so as to prevent the build-up of static electricity.

18 Claims, 7 Drawing Sheets

REMOVABLE RAISED TRAY SYSTEM FOR SMALL SET PRODUCTION

FIELD

The present disclosure relates to the field of printing systems, and more particularly, to a removable raised tray system for a printers that increase operator efficiency and ergonomics.

BACKGROUND

In the field of printing and bookmaking it has traditionally been the case to print large lots of a book in a single printing run and to then store the printed books in a warehouse or send them off to booksellers until purchased by customers. Because it can be difficult to predict the popularity of a book, it is often the case that too many books may be printed and/or purchases may not satisfy original expectations. As a result, books are often returned to the publisher for recycling. Additionally, because of the costs associated with overprinting or a lack of demand of books, publishers may decline to print books for which there is little perceived demand or readership and/or which deal with very specialized topics. As a result, authors and publishers can suffer lost opportunities and revenue. Additionally, in some cases, customers may be unable to obtain copies of some books because they are out-of-print.

In view of the above problems, there is an interest in the on-demand printing of single copies of books or the printing of small batches of books. Such on-demand printing allows books to be printed as needed in an on-demand manner and/or printed in very limited quantities that more satisfactorily meet customer demand. On-demand printing of books generally consists of receiving a request for the printing of a book, or a small batch of a book, printing the requested book, binding and covering the book, and shipping the book off to a paying customer. Oftentimes, the printing systems utilized for on-demand printing are the same printing systems that are utilized for very large printing requests. Due to the nature of printing small batches of books, the feeders and stacker trays/pallets of the large printing systems are typically not filled to capacity and/or only a limited amount of the printed media may be inserted into the feeder, or stacked on the stacker trays/pallets before the printed media must be removed by an operator for further processing. As a result of the small batches and the quick turnaround time required when printing several small batches of books, operators are often forced to repetitively insert print media into a feeder, or remove the printed media from the stacker trays/pallets, which stacker trays/pallets are often located very close to, and often only inches off, the ground. Hence, an operator is often forced to repeatedly bend very low to the ground each time media for a small printing batch is loaded, or a small printing batch is unloaded from a stacker tray/pallet, which can occur quite often when many small batches are successively printed. Such repetitive bending movements are unsatisfactory from workplace ergonomic standpoints and can often result in premature worker fatigue and/or injury. In addition to the above, in the case of existing printing systems and feeder and stacker trays/pallets there is a need for a solution that can be easily retrofitted and installed into such existing system by an operator without the need of tools or the modification of the existing feeder or stacker tray/pallet.

As such, there is a long-felt need to provide a printer feeder and printer stacker tray/pallet system that can perform both very large print jobs and smaller, on-demand print jobs, while also improving ergonomics and reducing the need for an operator to perform unnecessary repetitive movements when smaller, on-demand print jobs are performed.

SUMMARY

At the outset it should be understood that while the following disclosure, figures, and/or claims, etc. describe subject matter including one or more aspects described as either alone or in combination with one or more other aspects, the subject matter of the instant disclosure is not intended to be so limited. That is, the instant disclosure, figures, and claims are intended to encompass the various aspects described herein, either alone or in one or more combinations with one another. For example, while the instant disclosure may describe and illustrate a first aspect, a second aspect, and a third aspect in a manner such that the first aspect is only specifically described and illustrated relative to the second aspect, or the second aspect is only described and illustrated relative to the third aspect, the instant disclosure and illustrations are not intended to be so limiting and may encompass the first aspect alone, the second aspect alone, the third aspect alone, or one or more combinations of the first, second, and/or third aspects, e.g., the first aspect and the second aspect, the first aspect and the third aspect, the second and third aspect, or the first, second and third aspects.

Additionally, it is to be understood that while the instant disclosure describes a removable raised tray system used in association with a printer stacker, a stacker pallet/tray, and the modification of printer system parameters for use in association with a printer stacker, e.g., non-volatile memory settings (NVM's) of the printer stacker can be adjusted to a particular preset height to ensure that stacker sensors and/or the media output feeder of the stacker is properly calibrated/aligned with the particular preset height associated with the tray surface of the removable raised tray system, the removable raised tray system can be used in association with a printer media feeder and the printer system parameters modified for use with the printer media feeder, e.g., the non-volatile memory settings (NVM's) of the printer feeder can be adjusted to a particular preset height to ensure that feeder sensors and/or the printer feeder is properly calibrated/aligned with the particular preset height associated with a tray surface of the removable raised tray system.

According to aspects described and illustrated herein, there is provided a removable raised tray system for a print media feeder or stacker tray/pallet. The removable raised tray system generally includes a tray operatively arranged to receive media thereon. The tray includes an upper tray surface having an electrically conductive material, a lower tray surface, and at least one tray leg that is connected to the tray. The at least one leg is configured to support the tray at a position that is raised at a height relative to a platform surface of a media feeder or the stacker tray/pallet. The at least one leg includes a releasable fastening assembly, such as a rare earth magnet, that releasably secures the tray to the platform surface of the feeder or stacker tray/pallet. The electrically conductive material of the tray surface and the platform surface are electrically conductively connected to one another so as to prevent the build-up of and/or dissipate static electricity. By using rare earth magnets, an operator can easily attach and detach the removable raised tray system from a feeder or a stacker tray/pallet as needed, without the use of tools or the modification of an existing feeder or stacker tray/pallet.

In some aspects, the removable raised tray system includes at least four legs, each of which include the releasable fastening assembly. In some aspects, the releasable fastening assembly includes a magnet that magnetically releasably secures the raised tray system to the platform surface. In some aspects, the magnet comprises a rare earth neodymium magnet. In some aspects, the releasable fastening assembly comprises a pin member disposed at a terminal end of each tray leg that is receivable within a corresponding bore hole of the platform surface.

In some aspects, the at least one tray leg includes a plurality of tubes telescopically adjustable relative to one another such that a length of the at least one tray leg is adjustable such that the height of the raised tray system relative to the platform surface can be adjusted. In some aspects, the at least one tray leg comprises a ball detent assembly and plurality of bore holes such that the at least one leg is telescopically adjustable and releasably lockable to one or more preset positions/lengths. In some aspects, the at least one tray leg is pivotally secured to the tray such that the at least one tray leg can be rotated from a stowed position to an extended, operable position.

In some aspects, the removable raised tray system includes a plurality of sides that extend substantially perpendicularly from the upper tray surface to the tray lower surface. In some aspects, at least one of the plurality of sides includes at least one recess disposed between the upper tray surface and the lower tray surface, the recess extending from the at least one of the plurality of sides and toward a center of the tray. In some aspects, the removable raised tray system includes a plurality of recesses disposed between the upper tray surface and the lower tray surface, each of the plurality of recesses extend from a respective side of the tray and toward a center of the tray. Accordingly, when media is disposed atop the upper tray surface of a feeder or stacker, the at least one recess allows an operator to insert a hand into the recess to easily insert the media or grasp the media for removal.

In some aspects, each of the upper tray surface, the at least one tray leg, the releasable fastening assembly, and the platform surface are electrically conductive, and an electrically conductive ground wire connects the upper tray surface to the at least one tray leg.

These and other objects, features, and advantages of the present disclosure will become readily apparent upon a review of the following detailed description of the disclosure, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

Figure 1:
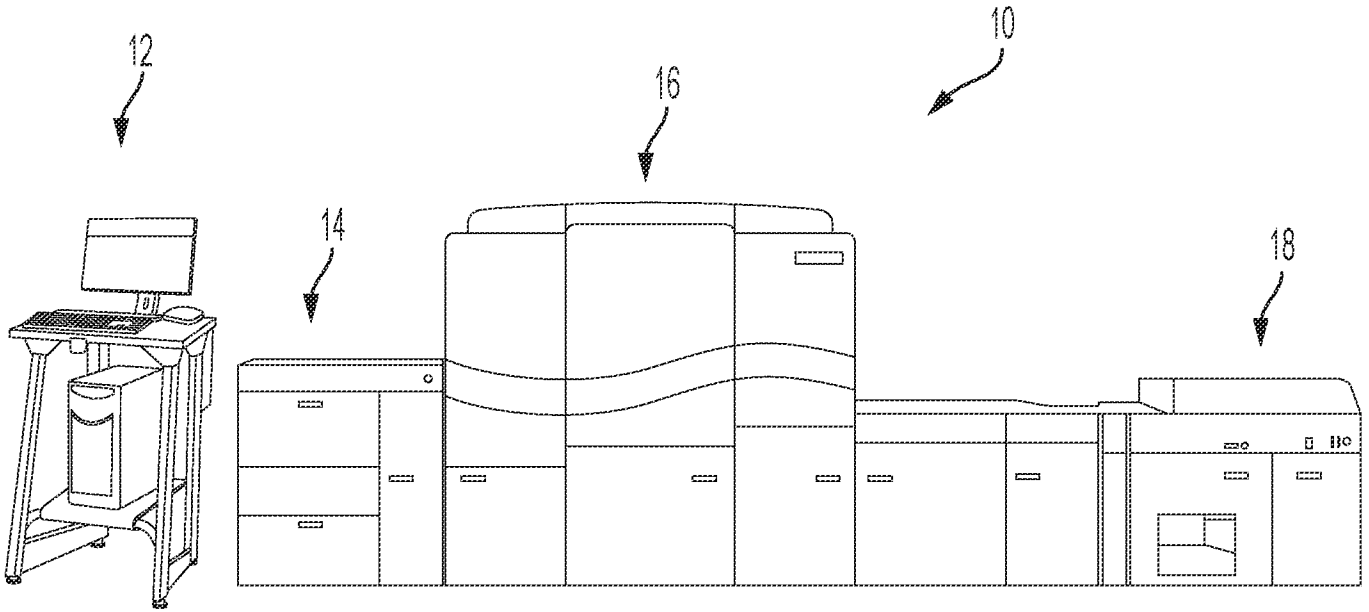
FIG. 1 is a front elevation view of a modular printing system including a print server, a feeder module, a printer module, and a stacker module.
Figure 2A:
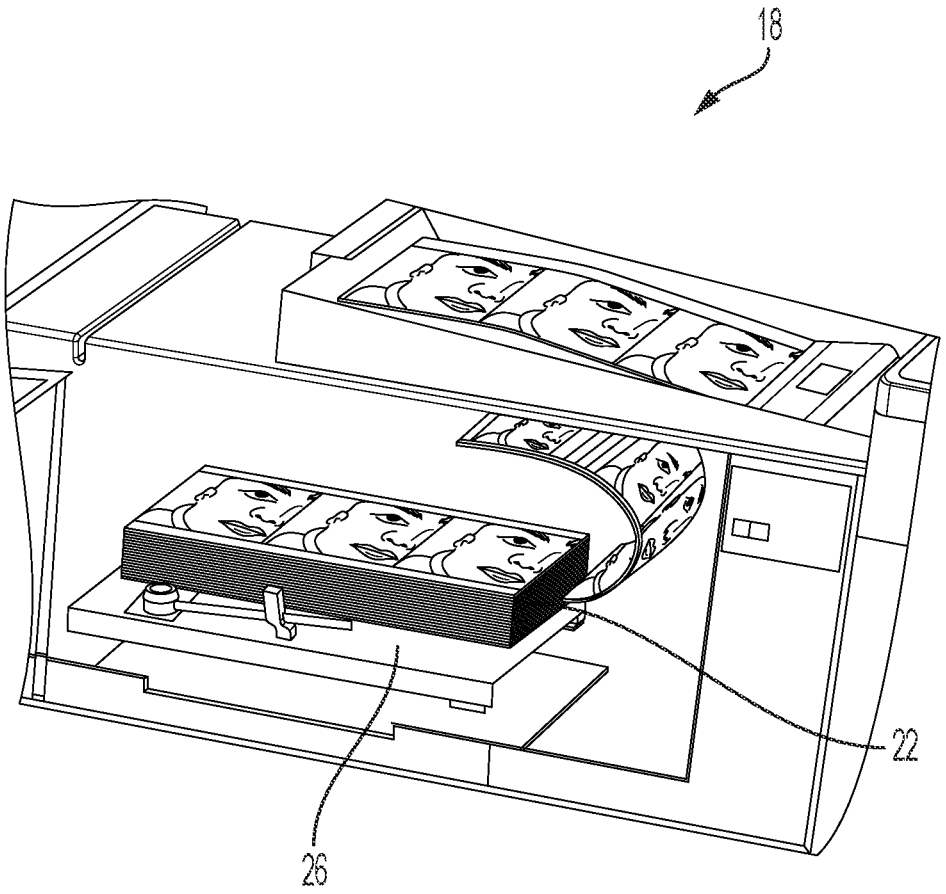
FIG. 2A is a three-dimensional cutaway view of the stacker module of FIG. 1.
Figure 2B:
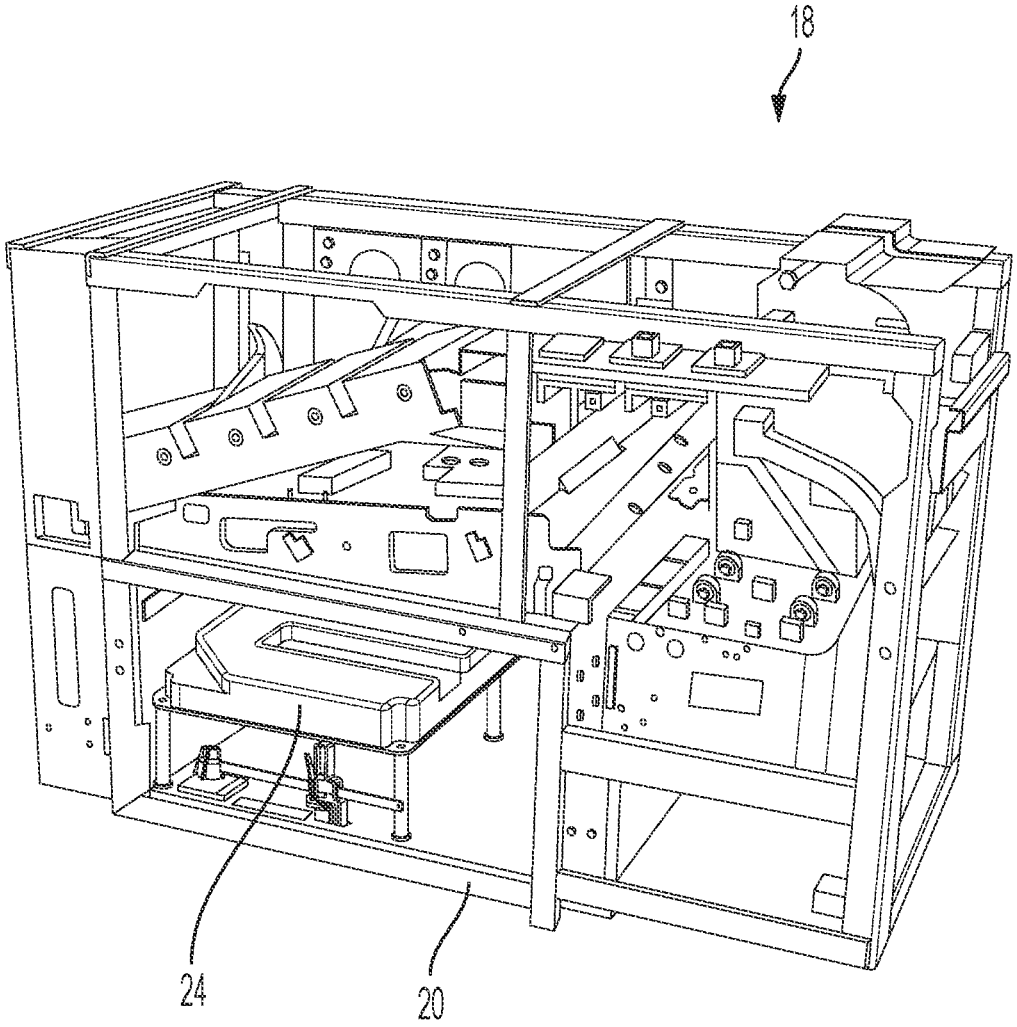
FIG. 2B is a three-dimensional cutaway view of the stacker module of FIG. 1 including a removable raised tray system in accordance with the instant disclosure.
Figure 3A:
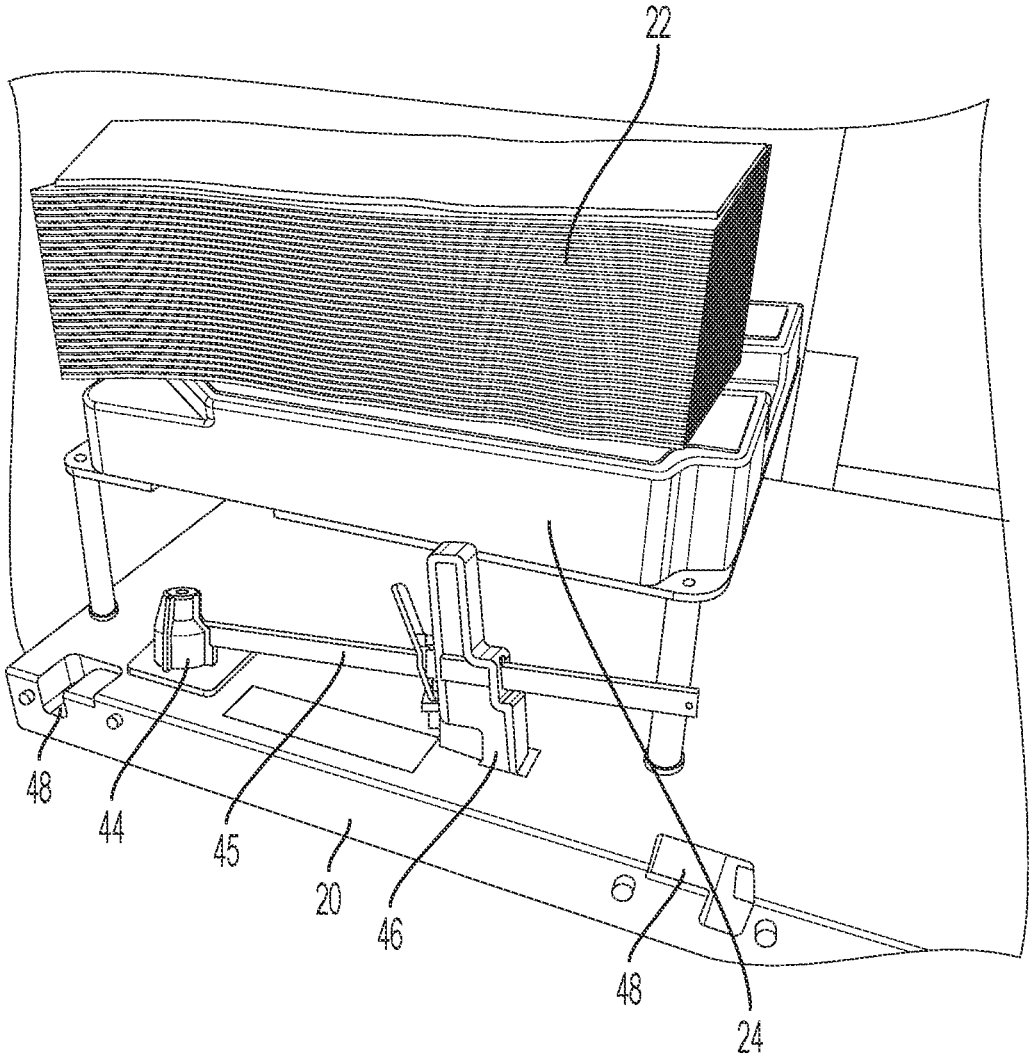
FIGS. 3A and 3B are three-dimensional views of a removable raised tray system in accordance with the instant disclosure showing media disposed thereon.
Figure 3B:
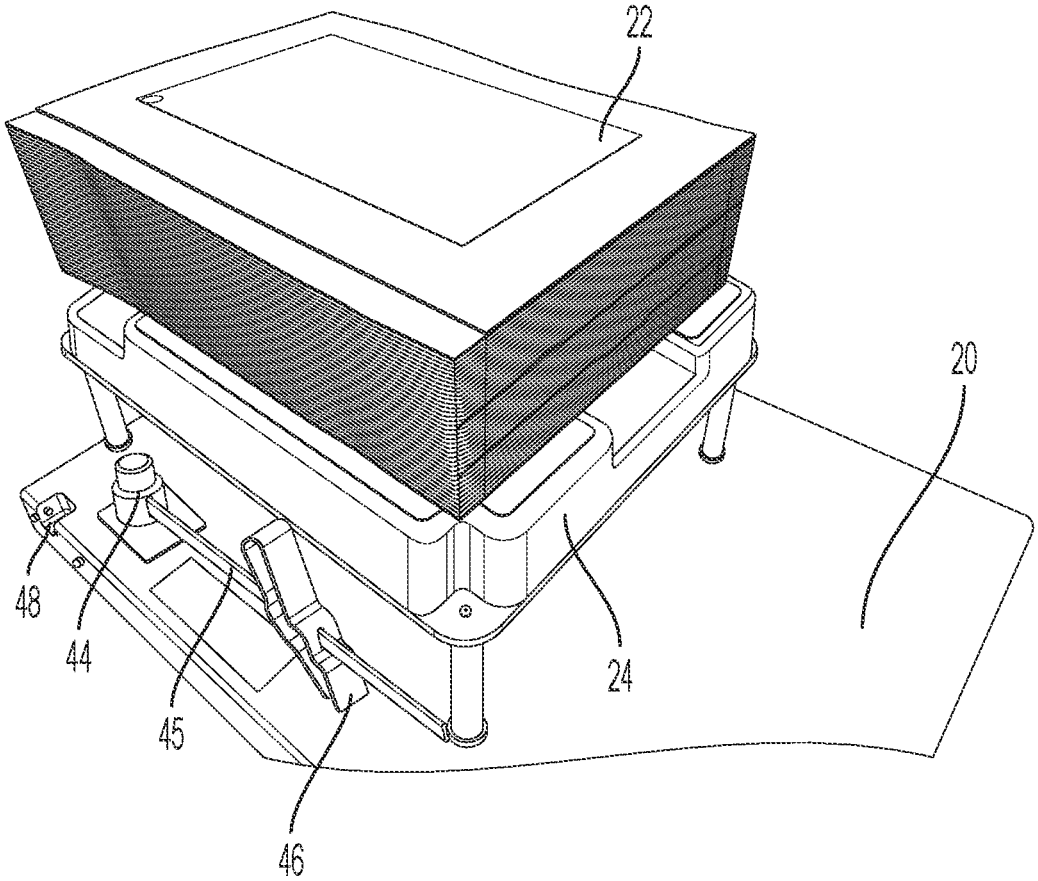

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments. The assembly of the present disclosure could be driven by hydraulics, electronics, pneumatics, and/or springs.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

It should be understood that use of "or" in the present application is with respect to a "non-exclusive" arrangement, unless stated otherwise. For example, when saying that "item x is A or B," it is understood that this can mean one of the following: (1) item x is only one or the other of A and B; (2) item x is both A and B. Alternately stated, the word "or" is not used to define an "exclusive or" arrangement. For example, an "exclusive or" arrangement for the statement "item x is A or B" would require that x can be only one of A and B. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Moreover, as used herein, the phrases "comprises at least one of" and "comprising at least one of" in combination with a system or element is intended to mean that the system or element includes one or more of the elements listed after the phrase. For example, a device comprising at least one of: a first element; a second element; and, a third element, is intended to be construed as any one of the following structural arrangements: a device comprising a first element;

a device comprising a second element; a device comprising a third element; a device comprising a first element and a second element; a device comprising a first element and a third element; a device comprising a first element, a second element and a third element; or, a device comprising a second element and a third element. A similar interpretation is intended when the phrase "used in at least one of:" is used herein.

"Printer," "printer system," "printing system," "printer device," "printing device," and "multi-functional device (MFD)" as used herein encompass any apparatus, such as a digital copier, bookmaking machine, facsimile machine, multi-function machine, etc., which performs a print outputting function for any purpose.

As used herein, "sheet," "web," "substrate," "printable substrate," and "media" refer to, for example, paper, transparencies, parchment, film, fabric, plastic, photo-finishing papers, or other coated or non-coated substrate media in the form of a web upon which information or markings can be visualized and/or reproduced. By specialty sheet it is meant a sheet which includes a card, label, sticker, pressure seal envelopes, mailers, or other element that is thicker than the substrate on or in which it resides.

"Printed sheet" as used herein is a sheet on which an image is printed as part of the print job.

As used herein, "process direction" is intended to mean the direction of media transport through a printer or copier, while "cross process direction" is intended to mean the perpendicular to the direction of media transport through a printer or copier.

As used herein, dry marking material refers to dry marking material particles used in xerography or electrophotography printing systems such as toner. Liquid marking material refers to a liquid ink used in ink jet printing systems.

As previously mentioned, it is to be understood that while the instant disclosure and illustrations describe a removable raised tray system used in association with a printer stacker, a stacker pallet/tray, and the modification of printer system parameters for use with a printer stacker, e.g., non-volatile memory settings (NVM's) of the printer stacker can be adjusted to a particular preset height to ensure that stacker sensors and/or the media output feeder of the stacker is properly calibrated/aligned with the particular preset height associated with the tray surface of the removable raised tray system, the removable raised tray system can be used in association with a printer media feeder and the printer system parameters modified for use with the printer media feeder, e.g., the non-volatile memory settings (NVM's) of the printer feeder can be adjusted to a particular preset height to ensure that feeder sensors and/or the printer feeder is properly calibrated/aligned with the particular preset height associated with a tray surface of the removable raised tray system.

Adverting now to the figures, FIG. 1 is a front elevation view of modular printing system 10. Modular printing system 10 is a digital printing system that can apply dry or liquid marking materials directly to a sheet to form an image. For example, modular printing system 10 can comprise, for example, a Xerox iGen series press type printing system currently available from the Xerox Corporation of Norwalk, Connecticut. Modular printing system 10 generally includes printer system server 12, feeder module 14, printer module 16, and stacker module 18.

Referring now to FIGS. 2A-4B, stacker module 18 is generally provided for receiving and stacking processed or printed media 22. As may be appreciated from the figures, stacker module 18 generally includes one or more stacker pallets/carts 20, which are configured for receiving processed or printed media 22 on a surface thereof, e.g., upon stacker pallet/cart surface 40, during so-called "normal" or larger-scale printing operations. As shown more clearly in FIGS. 4A and 4B, stacker pallet/cart 20 generally includes stacker pallet/cart surface 40, which receives processed or printed media thereon, pull handle assembly 42, adjustable/raisable media retaining assembly 44, pivot arm 45, height adjustable clamp 46, transport handle receivers 48, and wheel/casters 50.

Stacker pallet/cart surface 40 can be formed from an electrically conductive and magnetically attractive metal, or include an electrically conductive material and magnetically attractive metal so as to inhibit or dissipate the build-up of static electricity that typically results from printing operations.

Pull handle assembly 42 is provided so as to allow an operator to easily remove the stacker pallet/cart 20 from within a stacker module enclosure, for example, when moving completed print media from the stacker module enclosure for subsequent packaging and shipping elsewhere.

Adjustable/raisable media retaining assembly 44 includes pivot arm 45 and height adjustable clamp 46, which are provided for securing a stack of printed media atop the stacker pallet/cart 20, e.g., for transport purposes. That is, while the figures only show adjustable/raisable media retaining assembly 44, pivot arm 45, and height adjustable clamp 46 in a stowed position, it should be appreciated that the adjustable/raisable media retaining assembly 44, pivot arm 45, and height adjustable clamp 46 can be placed in an operable position by rotating pivot arm 45 upward such that it maintains a position that is substantially perpendicular to stacker pallet/cart surface 40, locking the pivot arm 45 in position, and then sliding and locking height adjustable clamp 46 along the length of the pivot arm 45 in order to snugly secure any printed media stacked upon the stacker pallet/cart surface 40.

Transport handle receivers 48 are provided for receiving and detachably securing a transport handle (not shown) to the stacker pallet/cart 20, which allows the stacker pallet/cart 20 to be more easily and ergonomically moved by an operator. Finally, a plurality of wheels/casters 50 are provided to allow the stacker pallet/cart 20 to be easily rolled from the stacker module enclosure and to another location, e.g., for packaging and shipping processes performed in another area, and vice-versa.

As previously set forth, while the above-described assembly is satisfactory for existing larger-scale printing operations, when several smaller printer jobs are performed, an operator may be forced to repeatedly remove the printed media from the stacker tray/pallet surface 40, which is located very close to the ground. In doing so, the operator is forced to bend very low to the ground each time a smaller printing job must be unloaded, which can occur quite often when many small batches are successively printed throughout a day. Accordingly, removable raised tray system 24 is provided in an effort to reduce the incidence of worker fatigue or injury.

As may be appreciated from FIGS. 2B-4B, removable raised tray system 24 is generally provided for raising the height of the stacking surface upon which printed media is stacked when smaller print jobs are performed, which tends to reduce the amount of bending (and the bending range) required to be performed by an operator in order to remove the printed media from the stacker module, while also allowing the printing system to be utilized for larger print jobs.

Removable raised tray system 24 is shown as generally including tray assembly 26, one or more legs 28, one or more fasteners 29, and one or more releasable fastening assemblies 30.

Figure 4A:
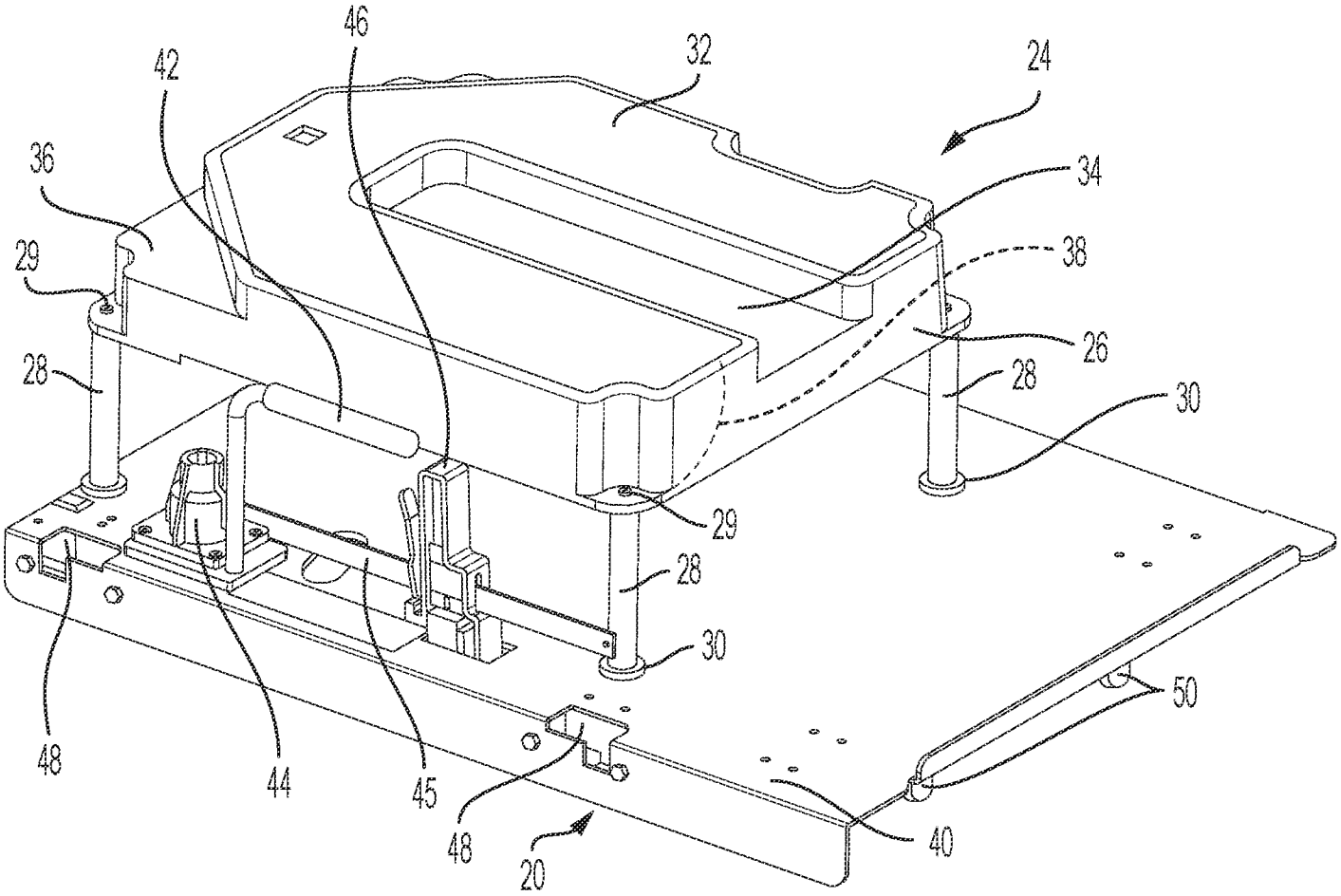
FIG. 4A is a three-dimensional view of a removable raised tray system in accordance with the instant disclosure; and, FIG. 4B is a three-dimensional exploded view of a removable raised tray system in accordance with the instant disclosure.
Figure 4B:
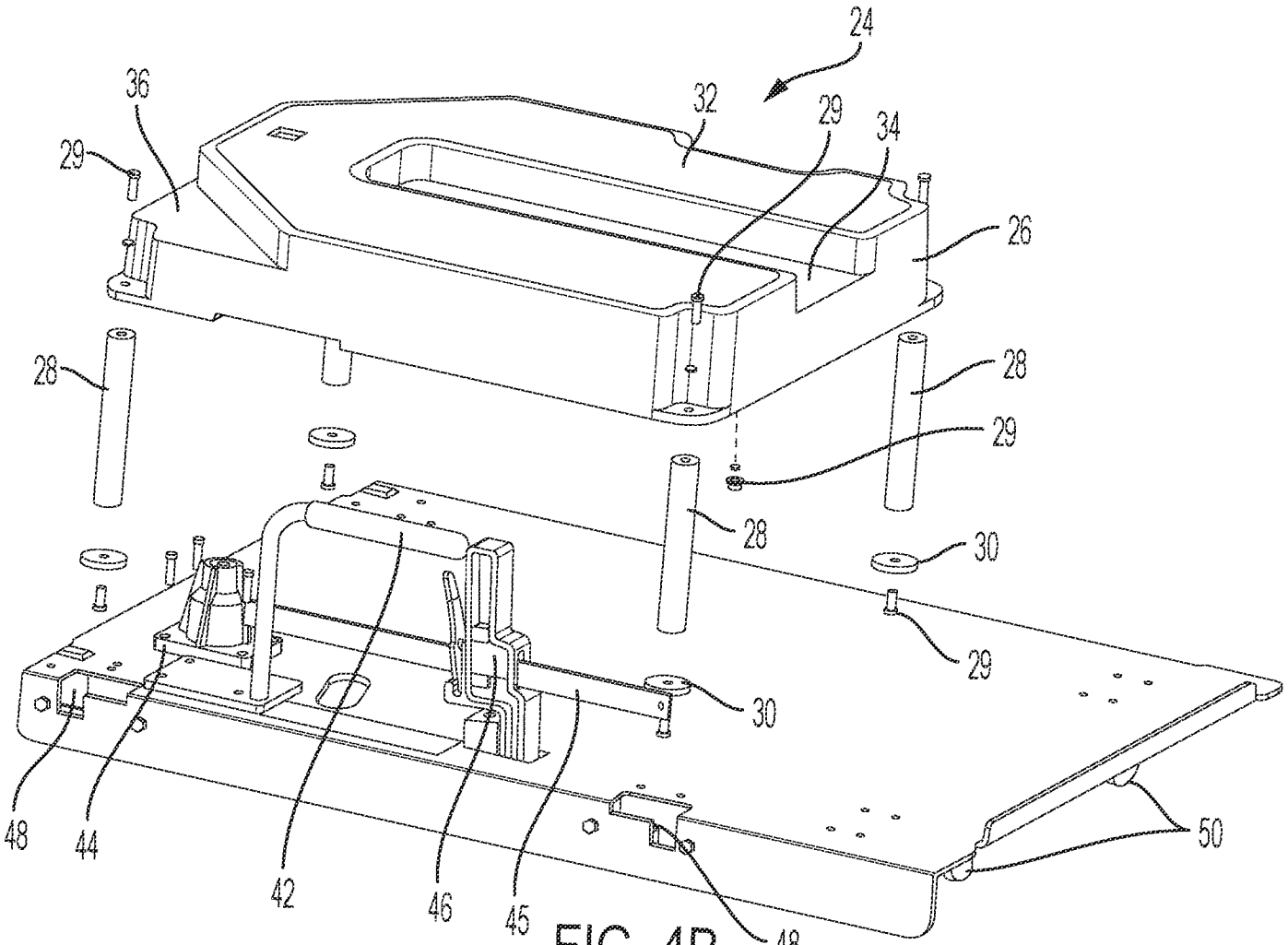

Tray assembly 26 generally includes tray surface 32 upon printed media may be stacked, recesses 34 and 36, and grounding strap/wire 38. Tray assembly 26 can be formed from a lightweight material, such as plastic, and tray surface 32 can be formed from, or include an electrically conductive metal, which is connected to grounding strap/wire 38 for purposes of inhibiting or dissipating the build-up of static electricity that typically results from printing operations. As shown in FIG. 4A, grounding strap/wire 38 is shown as connecting tray surface 32 to leg 28 via one or more fasteners 29, which are electrically conductive. As later discussed, leg 28 is electrically conductively connected with stacker pallet/cart surface 40. Recesses 34 and 36 are generally provided for allowing an operator to insert his/her hands below a stack of printed media atop the tray surface 32 to easily remove the stacked media from the tray surface 32. Preferably, the pair of recesses 34 and 36 are provided and disposed proximate opposite ends of the tray surface so as to allow the user to grasp a stack of media on opposite sides thereof, one end with each hand.

One or more legs 28 are provided for elevating tray surface 32 at a height above stacker pallet/cart surface 40. Legs 28 can comprise a metal or be formed to include an electrically conductive material so as to inhibit or dissipate static electricity. As shown in the figures, legs 28 are illustrated as being secured to tray assembly 26 via fasteners such as nuts, washers, and bolts, which can be electrically conductive as well, and at least one of legs 28 is shown as securing ground strap/wire 38. Legs 28 are also shown in the figures as additionally securing releasable fastening assemblies 30, which can comprise electrically conductive rare earth magnets. In some aspects, the rare earth magnets comprise neodymium, which provide sufficient magnetic attraction to secure the removable raised tray system in place during smaller printing jobs, while also allowing the removable raised tray system to be readily removed for larger printing jobs. As may be appreciated, due to the electrically conductive connection between the tray surface 32 and the stacker pallet/cart surface, the build-up of any static electrical charge that may result from printing operations can be inhibited or effectively dissipated.

As may also be appreciated, because the magnetic attachment of the removable raised tray system eliminates the need to alter an existing stacker pallet/cart 20, the removable raised tray system 24 can be easily mounted and removed from an existing stacker pallet/cart without alteration of an existing stacker pallet/cart 20 itself. In addition, as the tray surface 32 is electrically connected to the stacker pallet/cart surface 40 via the ground strap/wire 48, legs 28, and releasable fastening assemblies 30, any static electricity generated as a result of printing operations can be effectively dissipated. Furthermore, tray assembly 26 can be configured to interact directly with the height sensing system and output feeder of a stacker module to ensure smooth and seamless operation of the stacker, e.g., in a manner similar to the height adjusting system as set forth in U.S. Pat. No. 10,442,642, which patent is incorporated herein by reference in its entirety. That is, when the removable raised tray system is installed, system parameters, e.g., non-volatile memory settings (NVM's), can be adjusted by an operator to ensure that the stacker sensors and/or media output feeder are properly calibrated to the new height associated with tray surface 40.

Also, while it is not shown in the figures, the one or more legs 28 can be configured to comprise pin members that mate with respective bore holes in the stacker pallet/cart surface 40; this arrangement however, may require modification and machining of an existing pallet stacker surface so as to include the required bore holes, which may not be desirable from a retrofitting standpoint. The stacker pallet/cart surface 40 could also be configured to comprise one or more recesses or depressions that correspond with respective legs 28, which acted to additionally secure the removable raised tray system in place. In such configurations, rare earth magnets could also be additionally utilized to further secure the removable raised tray system 24 in place atop the stacker pallet/cart surface 40.

Also, while it is not shown in the figures, tray legs 28 can be formed of a plurality of telescoping tubes such that a length of each tray leg 28 is adjustable for purposes of adjusting the height of the removable raised tray system 24 relative to the stacker pallet/cart surface 40. In such aspects, tray legs 28 can comprise ball/detent assemblies such that the tray legs are telescopically adjustable and releasably lockable to one or more preset positions/lengths. Furthermore, while it is also not shown in the figures, for purposes of stowing the removable raised tray system when it is not in use, the legs 28 can be pivotally secured to tray assembly 26 such that each leg can be pivoted from a stowed position, e.g., along respective interior sides of the tray assembly 26, and to an extended, operable position, e.g., in a manner similar to a leg of a folding table. In such aspects, when the removable raised tray system is installed at one of a plurality of preset heights, the system parameters, e.g., non-volatile memory settings (NVM's), can be adjusted to the particular preset height to ensure that the stacker sensors and/or media output feeder is properly calibrated/aligned with the particular preset height associated with tray surface 40.

Also, while removable raised tray system 24 is shown as comprising a total of four tray legs 28, the raised tray system can be configured to comprise more or less than four tray legs 28. For example, the removable raised tray system 24 can be configured in a manner similar to a so-called murphy bed type drop down system that connected with a wall or side of the stacker module housing or enclosure. In such system, a first end of the removable raised tray system can be secured (removably or fixedly) to the stacker module housing or enclosure to support the first end of the tray assembly 26 at a height, and an opposite second end of the tray assembly 26 can be supported atop the stacker pallet/cart surface 40 via the one or more tray legs 28, which one or more legs can pivot from a stowed position to an operable position.

Hence, it is seen that in accordance with the instant disclosure there is provided an electrically grounded removable raised tray system for a printer stacker that improves ergonomics associated with the unloading of print media from a stacker pallet/cart when smaller print jobs are performed, while also allowing the printer stacker to remain available to perform large scale print jobs—all without the modification of the existing printer stacker or the stacker pallet/cart, or the need for an operator to use additional tools or hardware to mount and remove the removable raised tray system, thereby increasing printer availability, efficiency, and the operator experience.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE NUMERALS

10 Modular Printing system
12 Printer System Server
14 Feeder Module
16 Printer Module
18 Stacker Module
20 Stacker Pallet/Cart
22 Processed/Printed Media
24 Removable Raised Tray System
26 Tray Assembly
28 Leg
29 Fastener
30 Releasable Fastening Assembly (e.g., magnet)
32 Tray Surface
34 Recess (e.g., Hand Hold)
36 Recess (e.g., Hand Hold)
38 Ground Strap/Wire
40 Stacker Pallet/Cart surface
42 Pull Handle Assembly
44 Adjustable/Raiseable Media Retaining Assembly
45 Pivot Arm
46 Height Adjustable Clamp
48 Transport Handle Receiver
50 Wheel/Caster

What is claimed is:

1. A removable raised tray system for a printer system that is detachably securable to a platform surface operatively arranged to receive print media thereon, the platform surface comprising an electrically conductive material, the removable raised tray system comprising:

a tray operatively arranged to receive the print media thereon, the tray including an upper tray surface comprising an electrically conductive material and a lower tray surface; and, at least one tray leg connected to the tray and configured to support the tray at a position that is raised relative to the platform surface, the at least one leg including a releasable fastening assembly that releasably secures the tray to the platform surface, wherein, at least the electrically conductive material of the tray surface and the platform surface are electrically conductively connected to one another.

2. The removable raised tray system of claim 1, comprising at least four legs each including the releasable fastening assembly.

3. The removable raised tray system of claim 2, wherein the releasable fastening assembly comprises a magnet that magnetically releasably secures the raised tray system to the platform surface.

4. The removable raised tray system of claim 3, wherein the magnet comprises a rare earth neodymium magnet.

5. The removable raised tray system of claim 2, wherein the releasable fastening assembly comprises a pin member disposed on a terminal end of each of the at least four legs, the pin receivable within a corresponding bore hole of the platform surface.

6. The removable raised tray system of claim 1, wherein the at least one tray leg comprises a plurality of tubes telescopically adjustable relative to one another such that a length of the at least one tray leg is adjustable.

7. The removable raised tray system of claim 6, wherein the at least one tray leg comprises a ball detent assembly and plurality of bore holes such that the at least one leg is telescopically adjustable and releasably lockable to one or more preset positions/lengths.

8. The removable raised tray system of claim 1, wherein the at least one tray leg is pivotally secured to the tray such that the at least one tray leg is rotatable from a stowed position to an extended operable position.

9. The removable raised tray system of claim 1, including a plurality of sides extending substantially perpendicularly from the upper tray surface to the tray lower surface.

10. The removable raised tray system of claim 9, wherein at least one of the plurality of sides includes at least one recess disposed between the upper tray surface and the lower tray surface, the recess extending from the at least one of the plurality of sides and toward a center of the tray.

11. The removable raised tray system of claim 10 comprising a plurality of recesses disposed between the upper tray surface and the lower tray surface, each of the plurality of recesses extending from a respective side of the tray and toward a center of the tray.

12. The removable raised tray system of claim 10, wherein when media is disposed atop the upper tray surface, the at least one recess allows an operator to insert a hand into the recess below the media in order to grasp the media.

13. The removable raised tray system of claim 1, wherein each of the upper tray surface, the at least one tray leg, the releasable fastening assembly, and the platform surface are electrically conductive, and an electrically conductive ground wire connects the upper tray surface to the at least one tray leg.

14. A removable raised tray system for a printer system including a platform surface operatively arranged to receive media thereon, the platform surface comprising an electrically conductive material, the removable raised tray system comprising:

a tray operatively arranged to receive the media thereon, the tray including an upper tray surface comprising an electrically conductive material and a lower tray surface; and, a plurality of tray legs connected to the tray and configured to support the tray at a position that is raised relative to the platform surface, the plurality of legs including a rare earth magnet that releasably magnetically secures the removable raised tray system tray to the platform surface, wherein, at least the electrically conductive material of the tray surface and the platform surface are electrically conductively connected to one another.

15. The removable raised tray system of claim 1, wherein the printing system includes a printer stacker and the platform surface comprises a surface of a stacker pallet/tray operatively arranged to receive processed print media thereon.

16. The removable raised tray system of claim 1, wherein the printing system includes a printer feeder and the platform surface comprises a surface of the printer feeder operatively arranged to receive print media to be processed thereon.

17. The removable raised tray system of claim 14, wherein the printing system includes a printer stacker and the platform surface comprises a surface of a stacker pallet/tray operatively arranged to receive processed print media thereon.

18. The removable raised tray system of claim 14, wherein the printing system includes a printer feeder and the platform surface comprises a surface of the printer feeder operatively arranged to receive print media to be processed thereon.

* * * * *